United States Patent [19]

Alderman

[11] 4,047,346

[45] Sept. 13, 1977

[54] CHICKEN WIRE ROOF AND METHOD OF INSULATION

[76] Inventor: Robert J. Alderman, 812 59th St. NW., Bradenton, Fla. 33505

[21] Appl. No.: 656,642

[22] Filed: Feb. 9, 1976

Related U.S. Application Data

[63] Continuation-in-part of Ser. No. 649,911, Jan. 16, 1976, and a continuation-in-part of Ser. No. 494,097, Aug. 2, 1974, Pat. No. 3,969,863.

[51] Int. Cl.[2] ..... E04B 2/28; E04D 3/35

[52] U.S. Cl. ..... 52/407; 52/90; 52/127; 52/488; 52/743; 52/748

[58] Field of Search ..... 52/127, 404, 407, 743, 52/748, 735, 488, 90; 156/71, 577, 575

[56] References Cited

U.S. PATENT DOCUMENTS

| | | | |
|---|---|---|---|
| 1,153,836 | 9/1915 | Webb | 52/407 X |
| 1,414,332 | 4/1922 | Hartmann | 52/407 |
| 2,007,374 | 7/1935 | Kuehne | 52/407 X |
| 2,009,512 | 7/1935 | Offutt et al. | 52/407 X |
| 2,235,542 | 3/1941 | Wenzel | 52/743 X |
| 2,287,400 | 6/1942 | Wells, Jr. | 52/407 X |
| 2,845,150 | 7/1958 | McBerty | 52/407 X |
| 2,922,539 | 1/1960 | Figge | 156/575 X |
| 3,434,263 | 3/1969 | Beckman et al. | 52/735 |
| 3,513,614 | 5/1970 | Studzinski | 52/743 |
| 3,559,914 | 2/1971 | Alderman | 242/86.52 |

FOREIGN PATENT DOCUMENTS

| | | | |
|---|---|---|---|
| 725,115 | 3/1932 | France | 52/127 |
| 20,677 | 1912 | United Kingdom | 52/735 |

*Primary Examiner*—Alfred C. Perham

[57] ABSTRACT

An insulated roof structure is formed on an industrial building by mounting a support framework on the purlins in the partially completed roof structure and moving the framework along the length of the purlins. A reel of wire mesh and a reel of sheet material are carried by the framework over each of the spaces between adjacent ones of the purlins and the reels are progressively unrolled and the layers of wire mesh and sheet material are applied to the spaces between the purlins as the support framework moves. Additional insulation can be blown upon or otherwise applied to the sheet material to fill the spaces between the purlins, and hard sheets of roofing material are applied to the purlins as the support framework progresses across the structure.

12 Claims, 5 Drawing Figures

CHICKEN WIRE ROOF AND METHOD OF INSULATION

CROSS-REFERENCE TO RELATED APPLICATIONS

This application is a continuation-in-part of application Ser. No. 649,911 filed Jan. 16, 1976, and of application Ser. No. 494,097, filed Aug. 2, 1974, now U.S. Pat. No. 3,969,863.

BACKGROUND OF THE INVENTION

The roof structure of an industrial building typically comprises rafter beams which extend parallel to one another across the building and slope from the center of the building down toward its sides, and purlins which extend parallel to one another and which extend across and are mounted on the rafter beams. Hard sheets of exterior roofing material extend over and are attached to the purlins. In the past, when a roof structure of an industrial building was to be insulated, sheets of insulation material were placed across the purlins and the sheets of hard roofing material were attached to the purlins through the insulation material. The relatively thin sheets of insulation material were applied to the roof structure by the workmen using the sheets of hard roofing material which were already installed in the roof structure as a working surface. Reels of insulation material were first unwound on the hard sheets of roofing material and the long sheets of insulation material were moved by hand over onto the exposed purlins adjacent the hard roofing material and the lengths of the sheets of insulation material extended across the lengths of the purlins. The sheets of insulation material were stretched to prevent sagging between the purlins, and the hard roofing material was then placed over the insulation material and connected to the purlins.

As set forth in my prior U.S. Pat. No. 3,559,914, it has now become common practice to extend the sheets of insulation material along the length of the purlins so as to prevent the seams between adjacent sheets of insulation material from being exposed inside the building. The new procedure as set forth in my patent has reduced hazards to workmen on the roof by maintaining the reels of insulation material in a relatively static and available position on the exposed purlins without exposing long lengths of a sheet of material to the wind, while the workmen remain on the sheets of hard roofing material, so that the occasions when the workmen might be tempted to walk or climb out on the purlins to place or adjust the sheets of insulation material have been reduced. The prior art, however, still does not provide the workmen with a safe working space beyond the installed sheets of hard roofing material adjacent the working area where the reels of insulation material are being placed on the exposed purlins.

SUMMARY OF THE INVENTION

The present invention comprises an insulated roof structure for an industrial building and a method and apparatus for more safely forming the roof structure. Reels of wire mesh and reels of sheet material are supported by a framework mounted on the purlins of a roof structure, with a reel of wire mesh and a reel of sheet material positioned over each space between adjacent ones of the purlins. The framework also supports a worker's platform so that a worker can be positioned out over the purlins beyond the hard surface formed by the hard sheets of roofing material. The free ends of the reels of wire mesh and of the sheet material extend from the worker's platform back to the installed roof area so that the wire mesh forms a safety net for the workers.

The wire mesh in the installed roof structure can be supported by a lattice of support straps extending through the purlins, by various connectors which connect the edges of the wire mesh to the purlins, or by other support means, and the wire mesh and sheet material form a supporting surface for additional insulation.

Thus, it is an object of this invention to provide an improved insulated roof structure for an industrial building or the like, wherein an improved support surface is located in the spaces between adjacent ones of the purlins in the roof structure and wherein large thicknesses of heat insulating material can be supported in the spaces between the adjacent purlins.

Another object of this invention is to provide a method and apparatus for reducing the hazards to workers on a roof structure as the roof structure is being assembled.

Another object of this invention is to provide an inexpensive insulated roof structure for an industrial building and a method and apparatus for safely, expediently and economically applying an insulated roof structure to a building.

Other objects, features and advantages of the present invention will become apparent upon reading the following specification, when taken in conjunction with the accompanying drawings.

DETAILED DESCRIPTION

Figure 1:
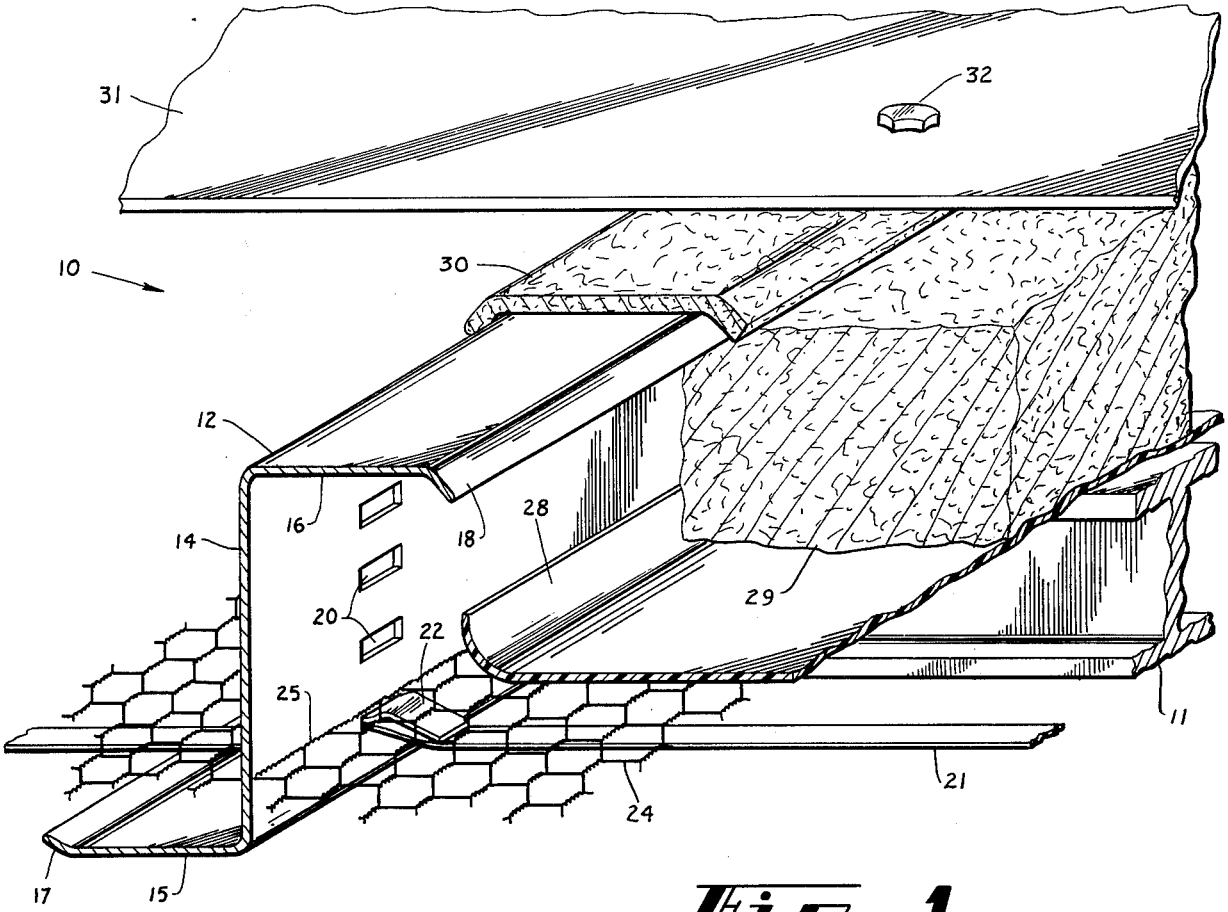
FIG. 1 is a detailed perspective illustration of the improved roof structure, with portions broken away to show the arrangement of the parts.

Referring now in more detail to the drawings, in which like numerals indicate like parts throughout the several views, FIG. 1 illustrates the roof structure 10 which includes a plurality of spaced parallel inclined rafter beams 11 and spaced parallel purlins 12 (only one of each shown). The purlins 12 rest upon and are supported by the rafter beams 11, and each purlin includes a central web 14, lower flange 15, and upper flange 16. The lower and upper flanges terminate in minor flanges or rims 17 and 18 which extend back toward the central web 14. A plurality of openings 20 are formed in vertically spaced groups in the central web 14 of each purlin, with the groups of openings being spaced equally along the length of the purlin. Thus, each group of openings 20 in the purlin illustrated in FIG. 1 will be in alignment with a similar group of openings in an adjacent one of the purlins (not shown) in the roof structure.

A plurality of support straps 21 are located in the group structure, with each support strap 21 being threaded through an opening 20 in each purlin and through the others of the openings aligned with the openings 20 and the other purlins. The support strap 21 in FIG. 1 is illustrated as being threaded through the lowermost opening 20, but it will be understood that the support strap 21 can be inserted through any one of the vertically spaced openings 20. A retainer clip 22 is wedged in the opening through which the support strap extends so as to form a friction connection between the purlin 12 and the support strap 21. The support strap 21 is placed under tension so that it extends in a substantially flat plane between adjacent ones of the purlins. The plurality of support straps 21 form insulation support means in the roof structure, as will be understood from the following description.

A layer of wire mesh 24 is placed on the support straps 21. The layer of wire mesh 24 is of a width substantially equal to the spaces between the central webs 14 of adjacent ones of the purlins 12 so as to span the space between the central webs 14 of the purlins, and the length of the strip of wire mesh 24 extends along the length of the purlins. The particular wire mesh illustrated in the drawing is a "chicken wire" mesh and includes a six-sided net fabricated from wire, such as aluminum wire; however, it will be understood that various other net or mesh material can be used. For example, wire cloth or square mesh or other types of web, net or mesh material can be substituted, if desired. Also, the mesh can be selected from various types of materials, as may be desired for particular installations. In the particular embodiment illustrated, the chicken wire mesh 24 includes a side hem 25 that is substantially straight and which lies adjacent the central web 14 of the purlin 12. The support straps 21 support the mesh 24 at spaced intervals along the lengths of the purlins 12, and tension is applied to the mesh 24 so as to prevent the mesh from sagging extensively between adjacent ones of the support straps.

Sheet material 28 is placed upon the mesh 24. The sheet material 28 is of a width slightly larger than the spaces between the central webs 14 of adjacent ones of the purlins 12 so that the edges of the sheet material 28 tend to lie up against the central web 14 of the adjacent purlins. The length of sheet material extends along the length of the space between the adjacent purlins, and the sheet material 28 can comprise various materials, including a vinyl or other tough vapor impermeable substance, with the particular selection of the material in the sheet 28 depending upon the particular specifications of the roof structure.

A quantity of heat insulation material 29 is inserted in the spaces between adjacent ones of the purlins and onto the sheet material 28. The insulation material 29 can be in the form of blocks of solid material, sheets of material, loose material, or material that was initially loose when placed in the space but sprayed or otherwise mixed with adhesive as or after being inserted into the spaces so as to become substantially rigid. The sheet material 28, wire mesh 24 and support straps 21 form a relatively flat and strong support surface for the insulation material 29, so that a large quantity of the insulation material can be installed in the roof structure, as may be desired.

Additional sheet insulation material 30 is applied to the top surface of the upper flange 16 of the purlin 12, and the hard sheets 31 of roofing material is placed on the sheet insulation material 30 and connected to the purlins 12 by self-tapping screws 32 or other fasteners. The additional sheet of insulation material 30 functions to reduce the transfer of heat between the hard sheets 31 of roofing material and the purlins 12, and the insulation material 29 in the spaces between adjacent ones of the purlins function to inhibit the transfer of heat between inside the building and the hard sheets of roofing material 31 by means of convection and radiation.

Figure 2:
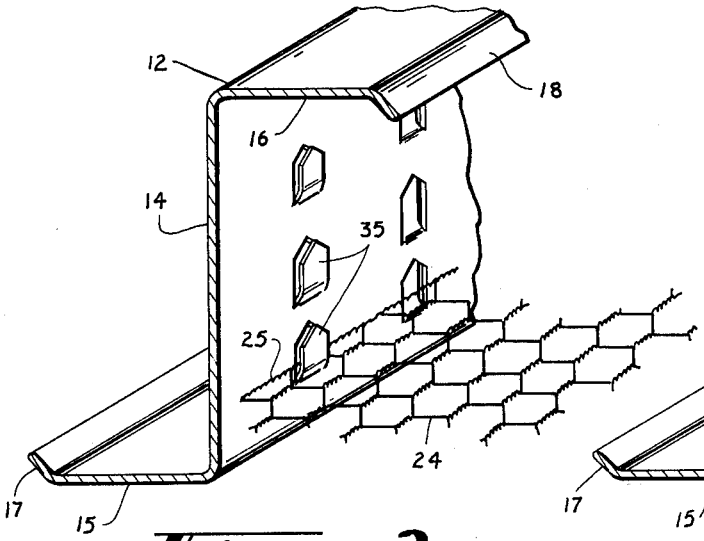
FIG. 2 is a detailed perspective illustration of a small portion of the roof structure with portions being removed for clarity, showing an alternate connection feature for the wire mesh.

As is illustrated in FIG. 2, the wire mesh 24 can be connected to the purlins 12 by alternate connection means, if desired. The central webs 14 of the purlins can have hooks or other fastening elements 35 punched therefrom and the hem 25 of the wire mesh can be inserted over the hooks. This system of supporting the edges of the wire mesh 24 can be used as a substitute for the support straps 21 or in addition to the support straps.

Figure 3:
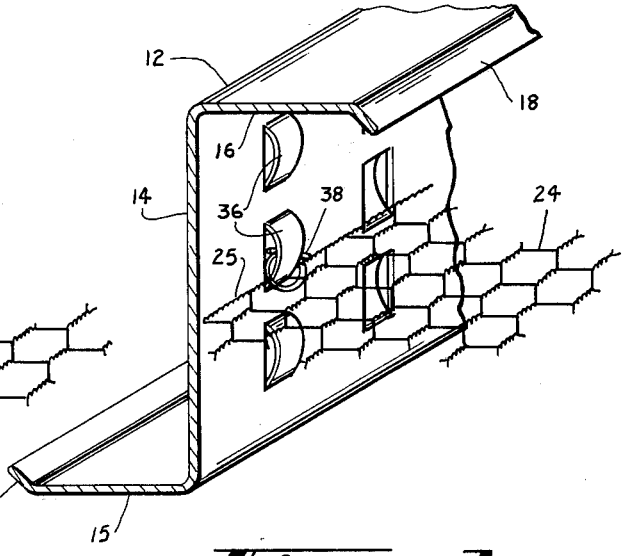
FIG. 3 is a detailed perspective illustration of a small portion of the roof structure with portions being removed for clarity, showing a second alternate connection feature for the wire mesh.

As is illustrated in FIG. 3, another alternate method of supporting the wire mesh 24 is illustrated, wherein a plurality of straps 36 are punched from the central web 14 of the purlin and hog clips 38 are threaded through the hem 25 of the wire mesh and through the straps 36. This system of connecting the wire mesh 24 to the purlins 12 also can be used in place of the support straps 21 of FIG. 1 or in addition thereto, if desired.

Since the strap openings 20, hooks 35 and straps 36 are vertically spaced, the wire mesh and sheet material can be positioned at different distances from the hard sheets of roofing material to accomodate different thicknesses of insulation and hold the insulation close to the hard sheets to roofing material.

Figure 4:
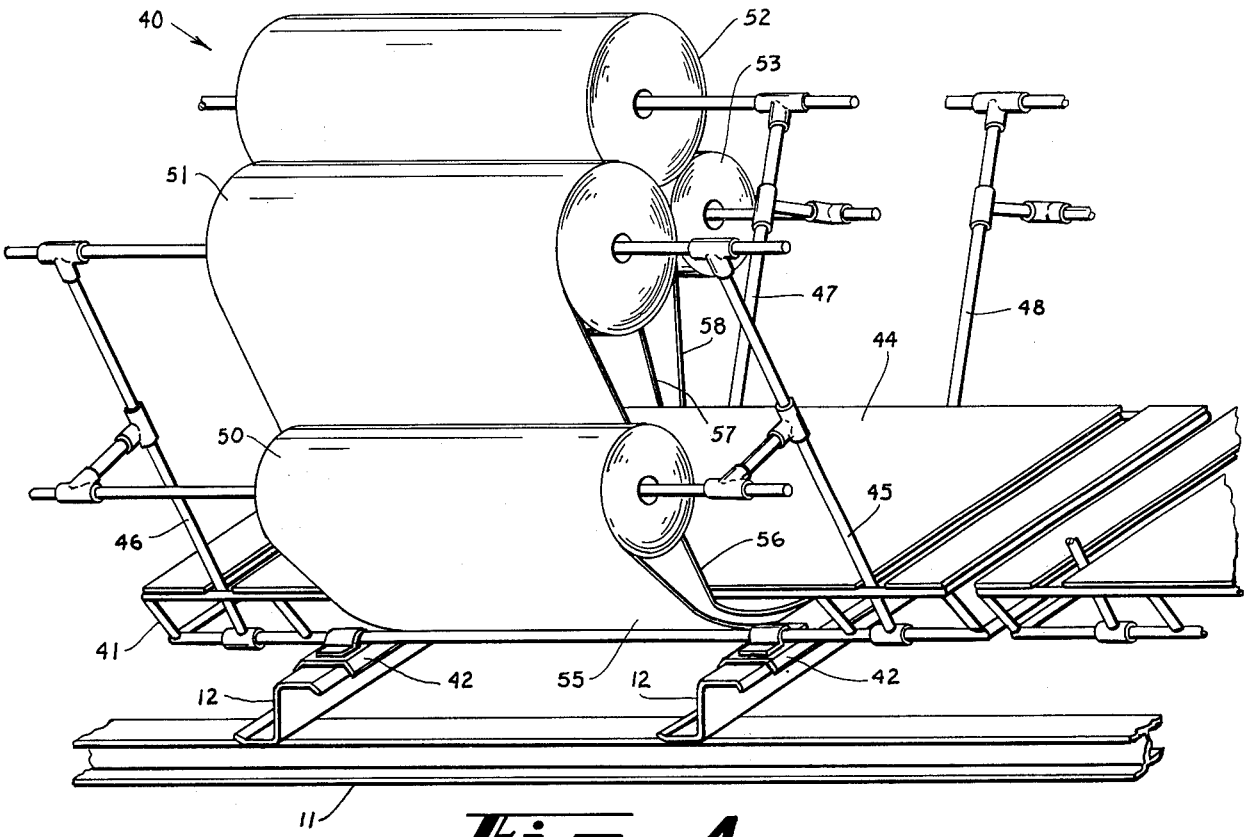
FIG. 4 is a partial perspective illustration of the apparatus for installing the wire mesh and sheet material.
Figure 5:
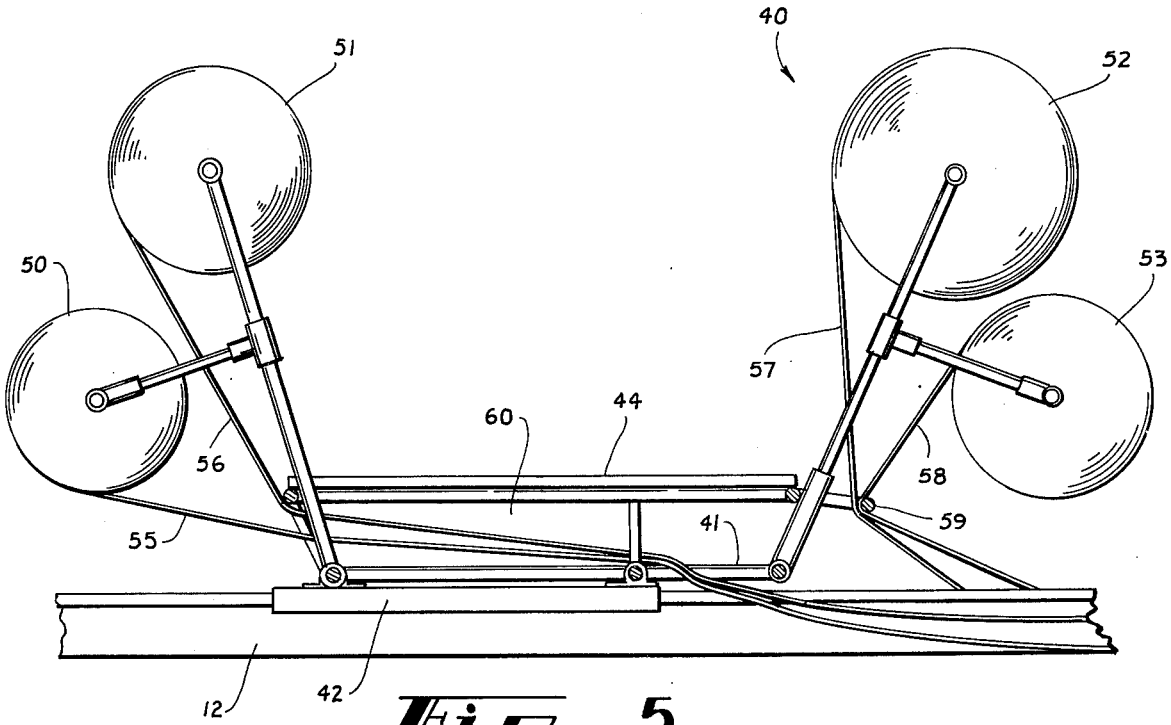
FIG. 5 is a side cross-sectional view of the apparatus illustrated in FIG. 4.

As is illustrated in FIGS. 4 and 5, the apparatus 40 for installing the roof structure is placed upon the purlins 12 and includes a framework 41 mounted on guide means 42 which engage each purlin 12. A more complete disclosure of the framework 41 of the apparatus is disclosed in my copending U.S. patent application Ser. No. 649,911. A worker's platform 44 is supported by the framework 41, and support stanchions 45 and 46 extend upwardly from the framework on one side of the platform while support stanchions 47 and 48 extend upwardly from the framework on the other side of the platform. The support stanchions 45–48 function to hold reels of material over the spaces between adjacent ones of the purlins and the free ends of the reels of material extend downwardly into the spaces between the purlins. In the particular embodiment illustrated, two reels 50 and 51 are supported over each alternate space between adjacent ones of the purlins at the leading edge of the apparatus 40 and two similar reels 52 and 53 are supported over the other alternate spaces between adjacent ones of the purlins at the trailing end of the apparatus. The reels 50 and 52 are reels of wire mesh, while the reels 51 and 53 are reels of sheet material, and the free ends 55, 56, 57 and 58 from each reel is directed downwardly into the spaces between the purlins, with the free ends 57 and 58 passing downwardly about bar 59 and with the free ends 55 and 56 passing through the space 60 in the framework 41 below the worker's platform 44 and then downwardly into the spaces between the purlins. The apparatus 40 can be moved along the partially completed roof structure by winch means (not shown) pulling the apparatus from one end of the building or by other driving systems, and as the apparatus 40 moves along the lengths of the purlins, the wire mesh and sheet material is progressively and simultaneously paid out.

The free ends 55 and 57 of the wire mesh from the reels 50 and 52 are paid out beneath the free ends 56 and 58 of the material from the reels 51 and 53 so that the wire mesh is located below the sheet material in the final roof structure. As the wire mesh and sheet material are placed in the spaces between the purlins, the hard sheets 31 of exterior roofing material are applied to the roof structure by other workers working on the hard working surface of the already-completed portions of the roof, and the free ends 55 and 57 of the wire mesh from the reels 50 and 52 span the space between the hard sheets of exterior roofing material 31 to the worker's platform 44, so that the wire mesh 24 functions not only to support the insulation being installed in the roof structure but as a safety net for the workers on the roof, so that if a worker should accidentally slip down between the purlins, the wire mesh 24 would tend to support the falling worker, at least temporarily. Moreover, the open weave of the wire mesh 24 would aid the worker in grasping or catching onto some lifesaving supporting surface. The connecting features illustrated in FIGS. 2 and 3 of the drawings would tend to keep the wire mesh 24 from parting away from the purlins 12 and forming a space to allow the worker to drop from the roof structure.

It will be understood that the foregoing relates only to a disclosed embodiment of the present invention, and that numerous changes and modifications may be made therein within the scope of the invention as defined in the following claims.

I claim:

1. In a roof structure comprising a plurality of approximately equally spaced purlins oriented parallel to one another in a common plane, each of said purlins including an upwardly extending central web and oppositely laterally extending upper and lower flanges, the improvement therein of each of said purlins defining groups of openings through its central web, said groups of openings being spaced along the length of the purlins with the openings of each group being variably spaced from the flanges of the purlins and with the openings of the purlins being in approximate alignment with the openings of the purlins on opposite sides thereof, a plurality of support straps oriented parallel to one another and extending through the openings of the central webs of said purlins, elongated strips of wire mesh positioned between and extending parallel to said purlins and resting on said support straps and spanning the space between the central webs of adjacent ones of the purlins, elongated sheets of substantially impervious material positioned between and extending parallel to said purlins and resting on said sheets of wire mesh and spanning the space between the central webs of adjacent ones of the purlins, a layer of heat insulation material extending over each sheet of material, and sheets of roofing material mounted on said purlins.

2. The roof structure of claim 1 and wherein said layer of heat insulation material comprises loose insulation material of thickness approximately equal to the height of the space between said sheets of material and said sheets of roofing material supported by said sheets of material and substantially filling the space between said support straps and said sheets of roofing material.

3. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and at least one laterally extending lower flange, the improvement therein of groups of connecting means formed in the central web of each purlin and spaced along the length of each purlin and with the connecting means of each group being variably spaced from the upper and lower flanges, elongated strips of wire mesh positioned between and extending parallel to said purlins and spanning the space between adjacent ones of said purlins and supported by said connecting means, sheets of material positioned between and extending parallel to said purlins and spanning the space between adjacent ones of the purlins and resting on said strips of wire mesh, sheets of roofing material mounted on said purlins and extending over said sheets of material, and heat insulation material beneath said sheets of roofing material and between said purlins supported by said sheets of material and substantially filling the space between said sheets of material and said sheets of roofing material.

4. The roof structure of claim 3 and wherein said groups of connecting means comprise hook means for connection to said wire mesh.

5. In a roof structure comprising a plurality of spaced rafters oriented parallel to one another, a plurality of approximately equally spaced purlins mounted on said rafters and oriented parallel to one another and perpendicular to said rafters, each of said purlins including an upwardly extending central web and laterally extending upper and lower flanges, and hard roofing material mounted on said purlins, the improvement therein of elongated strips of wire mesh of a width sufficient to substantially span the space between the central webs of adjacent ones of said purlins positioned between and extending parallel to said purlins, means for supporting said wire mesh at different levels between said upper and lower flanges, and insulation material between said purlins resting on and supported by said wire mesh.

6. A method of applying sheet material or the like to a roof structure of a building of the type including a plurality of purlins oriented in approximately parallel relationship with respect to one another, the steps of supporting reels of wire mesh and reels of sheet material over the spaces between adjacent pairs of purlins, unreeling the wire mesh and unreeling the sheet material into the spaces between adjacent ones of the purlins, progressively placing hard roofing material over the unreeled ends of the wire mesh and sheet material and on the purlins, and progressively moving the plurality of the reels along the lengths of the purlins ahead of the hard roofing material and unreeling the wire mesh and unreeling the sheet material into the spaces between adjacent ones of the purlins as the hard roofing material is placed over the unreeled ends of the wire mesh and sheet material.

7. The method of claim 6 and wherein the step of simultaneously moving the plurality of the reels along the lengths of the purlins comprises pulling the reels from one end of the building.

8. A method of applying a roof to a building of the type including inclined parallel rafters and a plurality of purlins with upwardly extending central webs and oppositely extending upper and lower flanges mounted on and extending across the rafters comprising extending a wire mesh support between adjacent ones of the purlins at a level above the lower flanges of the purlins, placing elongated sheets of vapor impermeable material on the wire mesh support between the purlins with the lengths of the sheets extending parallel to the purlins, placing insulation material on the sheets, and applying hard roofing material to the purlins over the insulation material.

9. The method of claim 8 and wherein the steps of extending a wire mesh support between adjacent ones of the purlins and placing elongated sheets of vapor impermeable material on the wire mesh support means comprises supporting reels of elongated sheets of the wire mesh and of the vapor impermeable material on the purlins, and simultaneously moving the reels along the purlins and paying out the wire mesh and the sheet material from the reels down between the purlins as the reels are moved along the purlins.

10. The method of claim 8 and wherein the step of placing insulation material on the sheets of vapor impermeable material comprises blowing loose insulation material onto the sheets.

11. A method of insulating a roof structure on a building of the type including a plurality of parallel purlins with upwardly extending central webs and oppositely extending upper and lower flanges comprising mounting a platform on the purlins, simultaneously moving the platform along the purlins and paying out layers of wire mesh and sheet material from the platform down between the upper flanges of the purlins into the spaces between the central webs of adjacent ones of the purlins, supporting the wire mesh from the purlins and supporting the sheet material on the wire mesh, placing insulation material on the sheets of material, and applying hard roofing material to the purlins.

12. The method of claim 11 and wherein the step of paying out layers of wire mesh and sheet material comprises supporting reels of wire mesh and sheet material over the spaces between adjacent ones of the purlins and paying out the wire mesh and sheet material from the reels, and wherein the step of placing insulation material on the sheets of material comprises placing loose insulation on the sheets of material.

* * * * *